US005832575A

United States Patent [19]

Sturino

[11] Patent Number: 5,832,575

[45] Date of Patent: Nov. 10, 1998

[54] CREMATORY URN

[76] Inventor: David P. Sturino, 1348 Black Ridge Dr., El Paso, Tex. 79912

[21] Appl. No.: 929,775

[22] Filed: Sep. 15, 1997

[51] Int. Cl.[6] ..... A61G 17/00

[52] U.S. Cl. ..... 27/1

[58] Field of Search ..... 27/1; 220/555, 220/553, 524; D99/5

[56] References Cited

U.S. PATENT DOCUMENTS

| | | | |
|---|---|---|---|
| D. 98,914 | 3/1936 | Briscoe . | |
| D. 152,759 | 2/1949 | Warren . | |
| 975,939 | 11/1910 | Edwards . | |
| 1,310,516 | 7/1919 | Xardell . | |
| 1,459,257 | 6/1923 | Reger . | |
| 1,887,071 | 11/1932 | Stiel | 220/553 |
| 2,092,392 | 9/1937 | Hewitt | 220/553 |
| 2,318,778 | 5/1943 | Hines | 220/553 X |
| 3,654,675 | 4/1972 | Peterson | 27/1 |
| 4,199,848 | 4/1980 | Kohnert | 27/1 |
| 4,324,026 | 4/1982 | Craft . | |
| 4,548,339 | 10/1985 | Gorman | 220/555 X |
| 5,029,373 | 7/1991 | Raymond . | |
| 5,285,922 | 2/1994 | Harding | 220/553 |
| 5,379,499 | 1/1995 | Jackson . | |

*Primary Examiner*—Kenneth J. Dorner
*Assistant Examiner*—William L. Miller
*Attorney, Agent, or Firm*—Stephen R. Greiner

[57] ABSTRACT

A crematory urn having a hollow body defining an interior chamber and having a pair of openings for access to the interior chamber. A sinuous or sinusoidal partition is positioned within the interior chamber and between the pair of openings so as to divide the interior chamber into two portions of substantially equal volume. A pair of removable closures are respectively positioned in the openings in the hollow body.

8 Claims, 1 Drawing Sheet

CREMATORY URN

FIELD OF THE INVENTION

The present invention relates generally to undertaking and, in particular, to a crematory urn having a bifurcated interior chamber.

BACKGROUND OF THE INVENTION

Due to the relatively high costs of traditional funerals and burial, cremation is becoming popular method for disposing of deceased dead bodies. Cremated remains are typically stored in a small container or urn and, then, interred in a cemetery plot or mausoleum. Married couples often desire to have their cremated remains placed side by side in a single urn. Unfortunately, urns having the ability to hold the remains of such a couple in the manner desired are not commercially available.

SUMMARY OF THE INVENTION

In view of the problems associated with the known containers for storing cremated remains, it is a principal object of the invention to provide a crematory urn having a bifurcated interior chamber for holding the cremated remains of two individuals side by side.

It is another object of the invention to provide an urn of the type described which may be filled through two access openings so that the remains of one individual positioned within the urn need not be disturbed when the remains of a second individual are added to the urn.

It is a further object of the invention to provide a crematory urn of the type described with a sinuous partition which serves to strengthen the urn and increase the area of contact between the bifurcated portions of the interior chamber so that the remains placed therein will be perceived to be more closely coupled.

Still another object of the invention is to provide a crematory urn whose contents may be discretely observed without opening the urn itself.

It is an object of the invention to provide improved elements and arrangements thereof in an apparatus for the purposes described which is lightweight in construction, inexpensive in manufacture, and fully dependable in use.

Briefly, the crematory urn in accordance with this invention achieves the intended objects by featuring a hollow body with a pair of openings for direct access to an interior chamber and a transparent base plate for visual inspection of the interior chamber. A sinuous or sinusoidal partition is positioned within the interior chamber and between the openings to divide the interior chamber into two portions of substantially equal volume with separate access. A pair of removable closures are respectively positioned in the openings in the hollow body.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
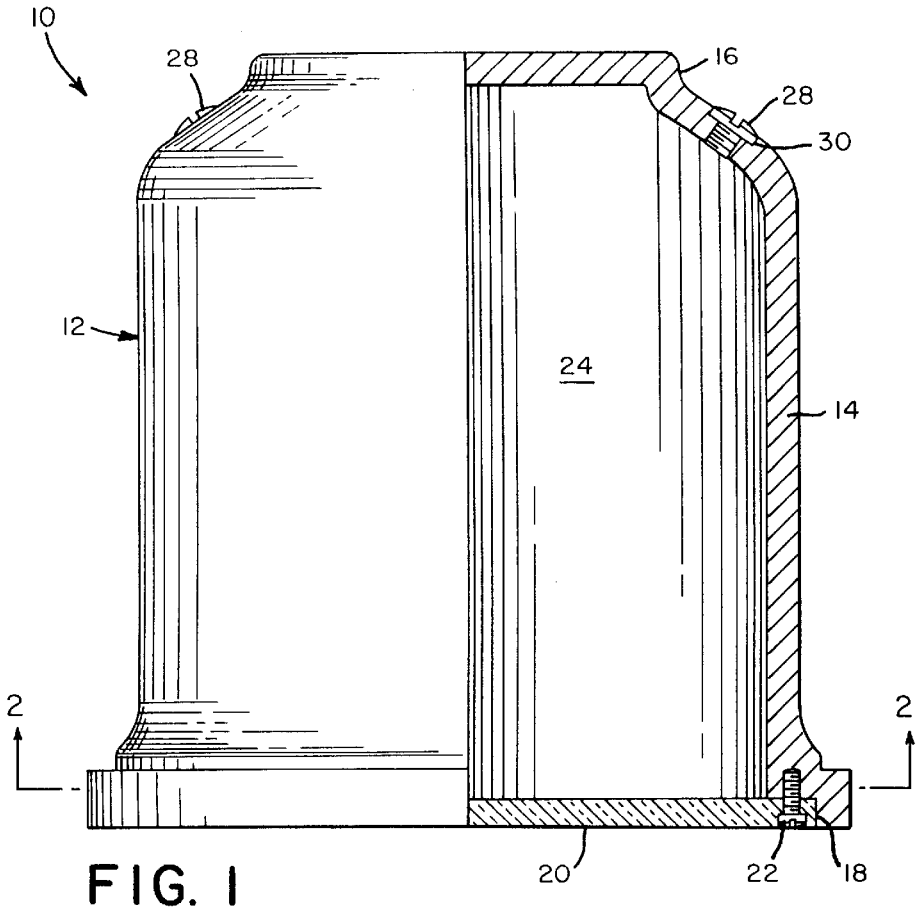
FIG. 1 is a side elevational view, partially in cross section, of a crematory urn in accordance with the present invention.
Figure 2:
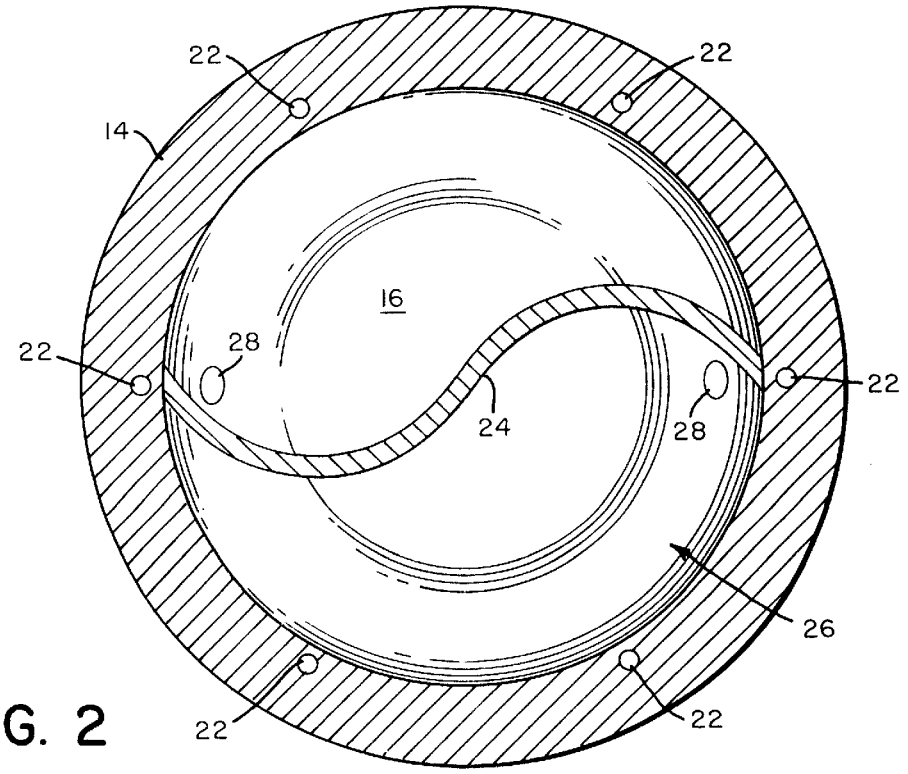
FIG. 2 is a cross-sectional view taken along line 2—2 of FIG. 1.

Referring now to FIGS., a crematory urn in accordance with the present invention is shown at 10. The urn 10 includes a hollow body 12 formed of metal or other suitable material. The body 12 has a cylindrical side wall 14 which is capped at its upper end by an integral top wall 16. The bottom end of the side wall 14 is provided with a circumferential recess 18 for receiving a transparent base plate 20 formed of plastic or glass. A number of screws 22 are positioned in corresponding, countersunk bores in the base plate 20 and the side wall 14 to secure the base plate 20 within the recess 18. A partition 24, formed of metal and having a horizontal cross section resembling a sine curve, is joined by welding or other suitable method to the side and top walls 14 and 16 of the body 12 so as to divide the interior chamber 26 thereof into two portions of equal volume. Each of the divided portions of the interior chamber 26 may be separately accessed through one of a pair of cap screws 28 positioned in countersunk bores 30 in the top wall 16.

While the urn 10 has been described with a high degree of particularity, it will be appreciated by those skilled in the art that modifications may be made thereto. For example, the particular shapes and proportions of the elements of the urn 10 may be varied as desired. Further, these elements may be joined together by any desired means. Therefore, it is to be understood that the present invention is not limited to the sole embodiment described above, but encompasses any and all embodiments within the scope of the following claims.

I claim:

1. A crematory urn, comprising:

a hollow body defining an interior chamber, said hollow body having an open bottom and having a pair of openings in the top thereof for access to said interior chamber;

a sinuous partition positioned within said interior chamber between said pair of openings so as to divide said interior chamber into two portions of substantially equal volume;

a transparent base plate secured to said hollow body so as to close said open bottom thereof; and, a pair of removable closures, each being respectively positioned in one of said openings in said hollow body.

2. The crematory urn according to claim 1 wherein said hollow body includes a cylindrical side wall, having an upper end and a lower end, and an integral top wall capping said upper end of said cylindrical side wall.

3. The crematory urn according to claim 2 wherein said sinuous partition is secured to said cylindrical side wall and said integral top wall of said hollow body.

4. The crematory urn according to claim 1 wherein each of said removable closures is a cap screw.

5. A crematory urn, comprising:

a hollow body defining an interior chamber, said hollow body having an open bottom and further having a pair of openings in the top thereof for access to said interior chamber, said hollow body being formed of a substantially rigid material;

a partition positioned within said interior chamber in said hollow body and between said pair of openings in said hollow body so as to divide said interior chamber into two portions of substantially equal volume, said partition having a sinusoidal cross section, said partition being formed of a substantially rigid material;

a transparent base plate secured to said hollow body so as to close said open bottom thereof; and, a pair of cap screws, each being respectively positioned in one of said openings in said hollow body.

6. The crematory urn according to claim 5 wherein said hollow body includes a cylindrical side wall, having an upper end and a lower end, and an integral top wall capping said upper end of said cylindrical side wall.

7. The crematory urn according to claim 6 wherein said partition is secured to said cylindrical side wall and said integral top wall of said hollow body.

8. A crematory urn, comprising:

a hollow body defining an interior chamber and having a pair of openings for access to said interior chamber, said hollow body being formed of a substantially rigid material, said hollow body including:

a cylindrical side wall having an upper end and a lower end, a circumferential recess being provided in said lower end thereof;

a transparent base plate secured within said circumferential recess; and, an integral top wall capping said upper end of said cylindrical side wall;

a sinusoidal partition positioned within said interior chamber between said pair of openings so as to divide said interior chamber into two portions of substantially equal volume, said partition being formed of a substantially rigid material, and said partition being secured to said side wall and said top wall of said hollow body; and, a pair of cap screws, each being respectively positioned in one of said openings in said hollow body.

* * * * *